US005226483A

United States Patent [19]

Williamson, Jr.

[11] Patent Number: 5,226,483

[45] Date of Patent: Jul. 13, 1993

[54] SAFETY VALVE LANDING NIPPLE AND METHOD

[75] Inventor: Jimmie R. Williamson, Jr., Carrollton, Tex.

[73] Assignee: Otis Engineering Corporation, Dallas, Tex.

[21] Appl. No.: 846,797

[22] Filed: Mar. 4, 1992

[51] Int. Cl.[5] ..... E21B 34/14

[52] U.S. Cl. ..... 166/375; 166/241.1; 166/317; 166/330; 166/376; 166/55.7

[58] Field of Search ..... 166/375, 376, 317, 330, 166/331, 241.1, 237, 123, 124, 181, 55.7

[56] References Cited

U.S. PATENT DOCUMENTS

| | | | |
|---|---|---|---|
| 1,629,058 | 5/1927 | Wilson | 285/391 |
| 1,896,104 | 2/1933 | Simmons | 166/242 |
| 3,442,536 | 5/1969 | Fowler | 285/27 |
| 3,661,207 | 5/1972 | Current et al. | 166/317 X |
| 4,273,186 | 6/1981 | Pearce et al. | 166/72 |
| 4,294,315 | 10/1981 | Yonker et al. | 166/322 |
| 4,460,046 | 7/1984 | Pringle | 166/317 |
| 4,478,288 | 10/1984 | Bowyer | 166/375 X |
| 4,534,414 | 8/1985 | Pringle | 166/376 X |
| 4,566,540 | 1/1986 | Pringle et al. | 166/317 |
| 4,721,162 | 1/1988 | Pringle et al. | 166/319 |
| 4,890,674 | 1/1990 | Le | 166/319 |
| 4,944,351 | 7/1990 | Eriksen et al. | 166/376 X |
| 4,981,177 | 1/1991 | Carmody et al. | 166/376 |
| 5,012,867 | 5/1991 | Kilgore | 166/188 |
| 5,082,061 | 1/1992 | Dollison | 166/378 |
| 5,095,994 | 3/1992 | Dollison | 166/386 |

*Primary Examiner*—Stephen J. Novosad
*Attorney, Agent, or Firm*—Jennifer R. Daunis

[57] ABSTRACT

A safety valve landing nipple selectively provides communication between a surface control line and the internal bore of said landing nipple by use of a rotary member. A rotary shifting tool is used to rotate the rotary member so that a cutting means shears the end of a shearable plug in the wall of the landing nipple, so as to provide communication between the surface control line and the internal bore of the landing nipple. A method of providing communication within a landing nipple between the surface control line and the internal bore of the landing nipple by use of the rotary shifting tool and a rotary shifting tool having a rotatable outer mandrel means, an inner mandrel means, a travel means and a diametrically retractable means.

58 Claims, 7 Drawing Sheets

FIG. 10A
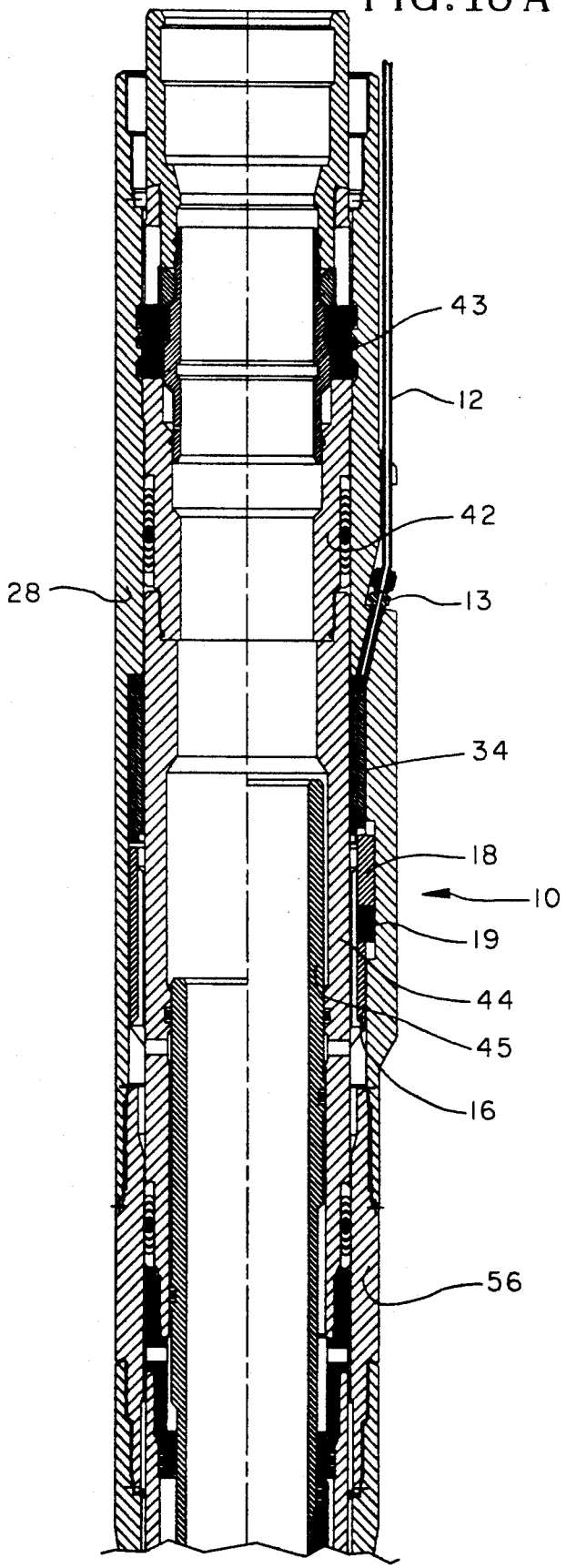
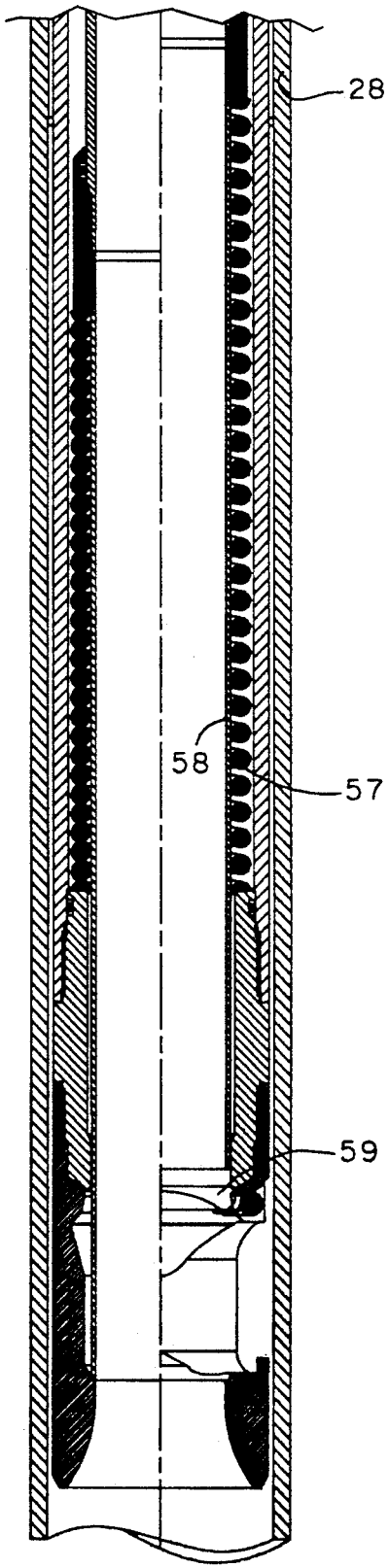
FIG. 10B

SAFETY VALVE LANDING NIPPLE AND METHOD

BACKGROUND OF THE INVENTION

A. Field of the Invention

This invention relates to a landing nipple. More particularly, this invention relates to a safety valve landing nipple which selectively provides communication between a surface control line and the internal bore of said landing nipple by use of a rotary sleeve.

B. The Prior Art

U.S. Pat. No. 4,294,315 discloses a landing nipple adaptable to be made up in a tubing string having a sliding sleeve disposed in its bore for selectively providing communication of balance and control pressure fluid to the nipple bore. Upon seal failure, the fluid invades the balance pressure fluid communication means instead of the control pressure fluid communication means.

U.S. Pat. No. 4,273,186 discloses a well safety system comprising a tubing retrievable safety valve and landing nipple which are connected by a common conduit for conducting a suitable pressure fluid for control and balance of the safety valve and a secondary valve landed in the landing nipple. Either the safety valve or the landing nipple may be selected for the control or balance fluids to flow into.

U.S. Pat. No. 4,566,540 discloses a hydraulic actuated communication nipple for switching control fluid from one location to a second location in a well tool. A ball is dropped down t he control line and seats on the piston, closing the fluid passage, moving the sleeve, and opening the fluid passageway to the bore. The piston also acts as a vertical moving plug to seal off the outlet with a metal to metal seal.

U.S. Pat. No. 4,981,177 discloses a downhole tool which may be a safety valve or stand alone nipple. A cutting tool is mounted for radial movement in a recess provided in the internal bore of the tubular housing. The control pipe is severed by the cutting tool and the severed portion of the pipe is crimped closed.

U.S. Pat. No. 4,721,162 discloses a well safety valve for use in a fluid well conduit through Which fluid is produced by pumping. A valve opens and closes in response to the fluid level in the conduit. When pumping is discontinued, the fluid level in the conduit increases to a predetermined high level to close the valve. When pumping begins, the fluid level falls and when it reaches a predetermined low level the valve is opened.

U.S. Pat. No. 4,890,674 discloses a subsurface safety valve with a flapper plate and operator tube where the operator tube telescopically retracts within the piston while the flapper plate rotates through the critical throttling region into sealing engagement against the flapper valve seat. The operator tube is retracted rapidly through the spring housing in response to rotation of the flapper plate, thus substantially reducing the magnitude of reaction forces which arise during dragging engagement between the flapper plate and the curved edge of the operator tube.

U.S. Pat. Nos. 1,629,058, 3,442,536, and 1,896,104 show known rotary locking systems but do not relate to a rotary landing nipple and rotary shifter.

U.S. Pat. No. 5,082,061 and co-pending U.S. patent application Ser. No. 07/610,708 (now allowed), both assigned to Otis Engineering Corporation for Rotary Locking System with Metal Seals and Flow Actuated Safety Valve with Retrievable Choke and Metal Seals, respectively, are also relevant.

U.S. Pat. No. 5,082,061 discloses a landing nipple connectible in a well conduit. The landing nipple has an internal metal seat and helically profiled segments with upper orienting surfaces. A well flow control device is connected to a rotary lock mandrel, which is connected to a rotary running tool and lowered into the well conduit and landing nipple. Repeated downward impact on the running tool rotates the rotary lock mandrel and segments into locking engagement with the landing nipple segments, sealingly engaging the lock mandrel metal seal surface with the landing nipple metal seat.

Ser. No. 07/610,708 discloses a direct acting safety valve having a flapper valve, all metal to metal seals, and a retrievable flow choke carried on a lock mandrel, which locks and seals in the safety valve operating tube. Production flow impingement force on the flow choke overcomes the force of a roller type snap closure device and a spring holding the operating tube in valve open position, releasing the operating tube to move upward quickly to a position permitting the flapper valve to close.

U.S. Pat. No. 4,460,046 discloses a control fluid communication nipple with a vertically moving sleeve which breaks a screw in tension and exposes the cavity in the crew to the interior of the well tool.

U.S. Pat. No. 4,566,540 discloses a hydraulically actuated control fluid communication nipple with a vertically moving sleeve which opens the fluid passageway to the bore when a ball is dropped down the control line, seats on the piston and closes the fluid passage.

U.S. Pat. No. 5,012,867 discloses a well flow control system in a well conduit including a landing nipple.

The use of a longitudinal or vertically moving shifting means is not sufficient to prevent premature lockout because unintended shifting can easily take place. However, it is unlikely that standard wireline tools can provide enough torque to unintentionally rotate a rotary member. Thus, a landing nipple with a rotary member used to selectively provide communication between the surface control line and the internal bore of the landing nipple is needed so that premature lockout is prevented.

SUMMARY OF THE INVENTION

The present invention encompasses a landing nipple comprising a nipple profile sub, a landing nipple housing connected to the nipple profile sub, a rotary member positioned inside the nipple profile sub, wherein the rotary member contains at least one slot or protrusion therein for engagement by one or more lugs of a rotary shifter, a bore in the wall of the nipple profile sub, to which is connected a surface control line and a means for selectively providing communication between the surface control line and the internal bore of said landing nipple. The nipple may also contain a means for guiding the rotary shifter. Preferably the means for selectively providing communication comprises a cutting means in the rotary member and a shearable plug assembly in the wall of the nipple profile sub.

Also encompassed herein is a method of providing communication within the landing nipple between the surface control line and the internal bore of the landing nipple which comprises the steps of placing a means for rotation within a nipple profile sub and rotary member and rotating said rotary member an amount sufficient to cause at least a portion of a shearable plug assembly placed within the wall of said nipple profile sub to sever so as to provide communication between said surface control line and said internal bore of said landing nipple.

Also included herein is a rotary shifting tool comprising a rotatable outer mandrel means for releasably engaging a desired rotatable means of a piece of equipment, an inner mandrel means slidable in a longitudinal direction within said rotatable outer mandrel means, wherein said inner mandrel contains at least one at least partially curved groove along the longitudinal axis of the inner mandrel means, a travel means for traveling within the groove of the inner mandrel means, the travel means connected to the rotatable outer mandrel means, wherein the travel means rotates as the travel means travels along the curved portion of the groove, thereby causing the outer mandrel means to rotate, and a diametrically retractable means for prevention of rotation of the inner mandrel means through which the inner mandrel means can slide and which allows rotation of the outer mandrel means and the travel means.

DESCRIPTION OF THE DRAWINGS

FIG. 10A-B are elevational views in cross section of the landing nipple of the invention with insert safety valve and lock mandrel in place.

DETAILED DESCRIPTION OF THE INVENTION

Figure 1:
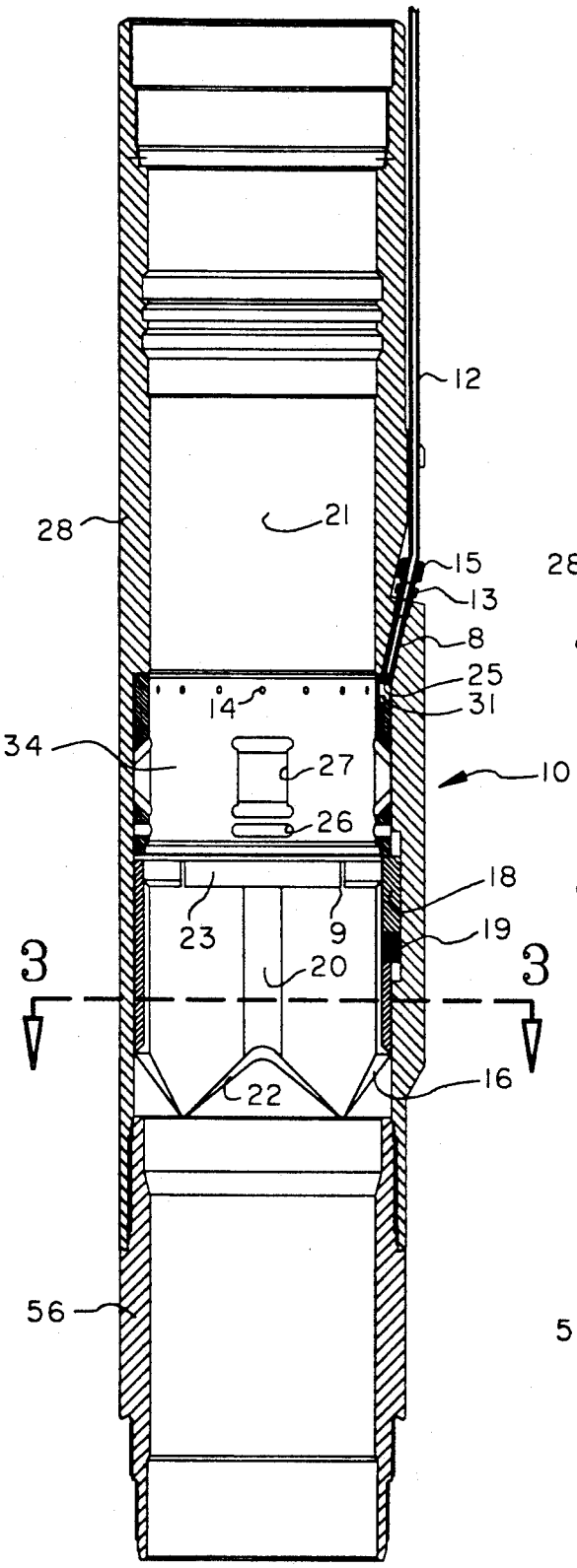
FIG. 1 is an elevational view in cross section of the landing nipple of the invention.

FIG. 1 shows landing nipple 10 with control line 12 to the well surface control manifold. Landing nipple 10 is rotary operated as will be explained. Landing nipple 10 is made up of a nipple profile sub 28 which is threaded to landing nipple housing 56.

Rotary sleeve 34 is provided with one or more slots 26 and extended slots 27 and is positioned inside nipple profile sub 28. Slots 26 and 27 are provided in sleeve 34 for engagement by one or more keys 30 of a rotary shifter assembly 24, as discussed further below. Slots 26 and extended slots 27 are present in the preferred embodiment of this invention but are not necessarily required. Rotary sleeve 34 contains slots 26 and extended slots 27 which are held in radial alignment with slot 20 in guide sleeve 16. Because of the narrow width of slots 26, extended slots 27 and slot 20 and the spacing of the 45 degree angles at each end, only a unique shifter assembly 24 can be used to provide the unique selective communication of this invention, thus avoiding accidental shifting.

Rotary sleeve 34 is also provided with one or more apertures 14, preferably a plurality of apertures 14, which provide access to internal bore 21 of landing nipple 10 and communication between the internal diameter of rotary sleeve 34 and the outside diameter of rotary sleeve 34. Rotary sleeve 34 may be of any suitable configuration whereby rotation can be achieved.

Figure 3:
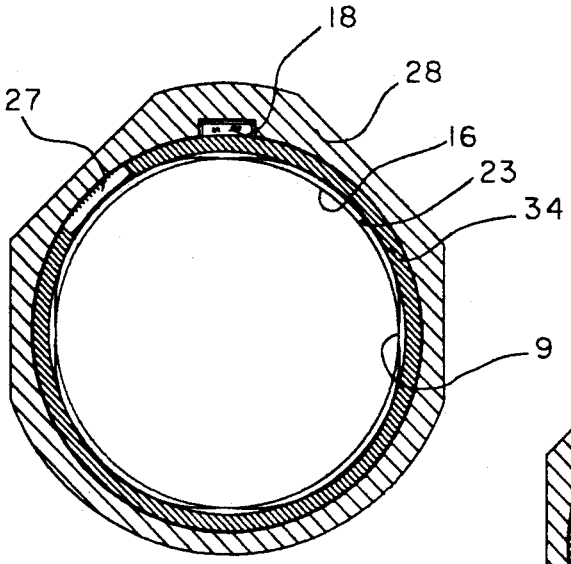
FIGS. 3 and 3A are cross sectional views of the landing nipple of the invention taken along line 3—3 of FIG. 1.

FIG. 3 shows a cross-sectional view of FIG. 1 taken along line 3—3 which shows nipple profile sub 28 and sleeve 34 before sleeve 34 has been rotated.

An optional means for guiding rotary shifter 24 into engagement with rotary sleeve 34, preferably guide shoe 16, may be positioned inside nipple profile sub 28, contiguous to sleeve 34. Rectangular key 18 is positioned in the housing of nipple profile sub 28 and guide shoe 16. Key 18 holds stationary slot 20 and orienting slots 22 in guide shoe 16 in the desired position. Compression spring 19 applies an upward acting force on key 18 and a downward force on guide shoe 16.

Guide shoe 16 is provided with orienting slots 22 which assist in positioning or orienting rotary shifter assembly 24 along stationary slot 20. Guide shoe 16 is also provided with lobe 23 which is better illustrated in FIG. 3, taken along Section 3—3 of FIG. 1. In the preferred embodiment, there are four lobes 23 spaced apart in guide shoe 16. Lobes 23 reduce to point 9 as shown in FIG. 1 and FIG. 3. Guide shoe 16 is not necessary to this invention but represents the preferred embodiment.

Figure 3A:
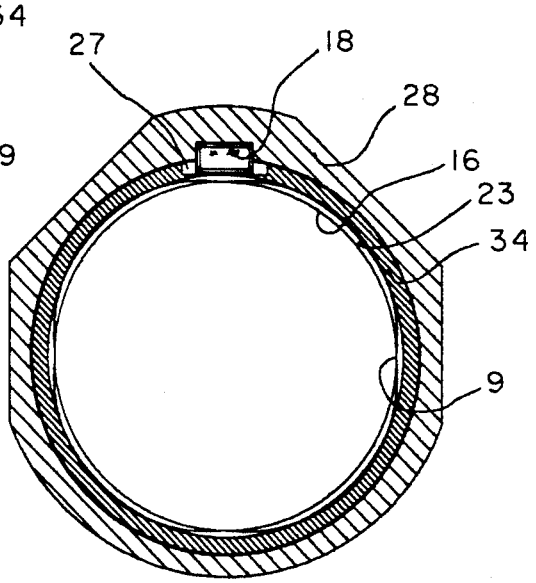

FIG. 3A shows a cross-sectional view of FIG. 1 taken along line 3—3 which shows nipple profile sub 28 and sleeve 34 after sleeve 34 has been rotated 45 degrees. Rectangular key 18 is in extended slot 27. When the release position is reached, keys 30 are moved radially inward by the points 9 and the square shoulder cannot engage. At the release position, rectangular key 18 is pushed upward by spring 19 into extended slot 27 in sleeve 34. This locks sleeve 34 from further rotational movement and ensures that sheared end 25 is held several degrees away from the end of plug fitting 13.

Still referring to FIG. 1, a shearable means, preferably a metal-to-metal plug fitting 13 is attached to control line 12 by fitting adapter 15. It should be understood that plug fitting 13 is only one of many means by which communication between control line 12 and the internal bore 21 of landing nipple 10, and thus an insert safety valve if desired, can be established, by use of rotary sleeve 34.

Figure 2A:
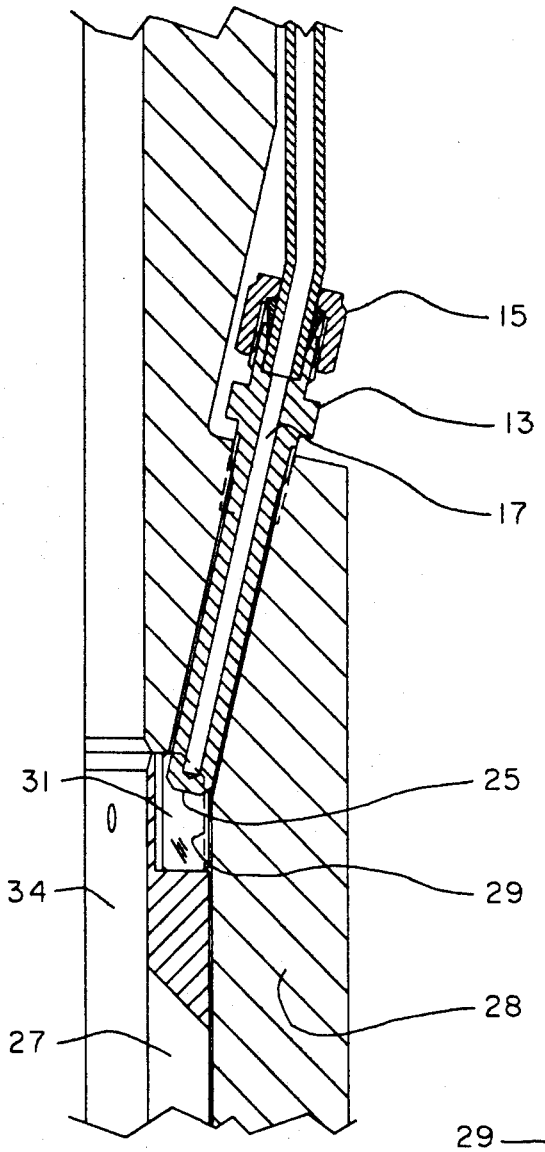
FIGS. 2A-B are enlarged cross sectional views of two means for selectively providing communication between the surface control line and the internal bore of the landing nipple.

Referring to FIG. 2A, in the preferred embodiment, plug fitting 13 has placed therein an internal bore 17 through which the control line fluid can pass. End 25 extends through rotary sleeve 34 into cutting space 31. End 25 is sheared off by cutter 29 which is attached to rotary sleeve 34, thus providing communication between internal bore 17 of control line 12 and the inside of landing nipple 10. This plug is preferred because it only utilizes one leak path instead of two or more leak paths.

Figure 2B:
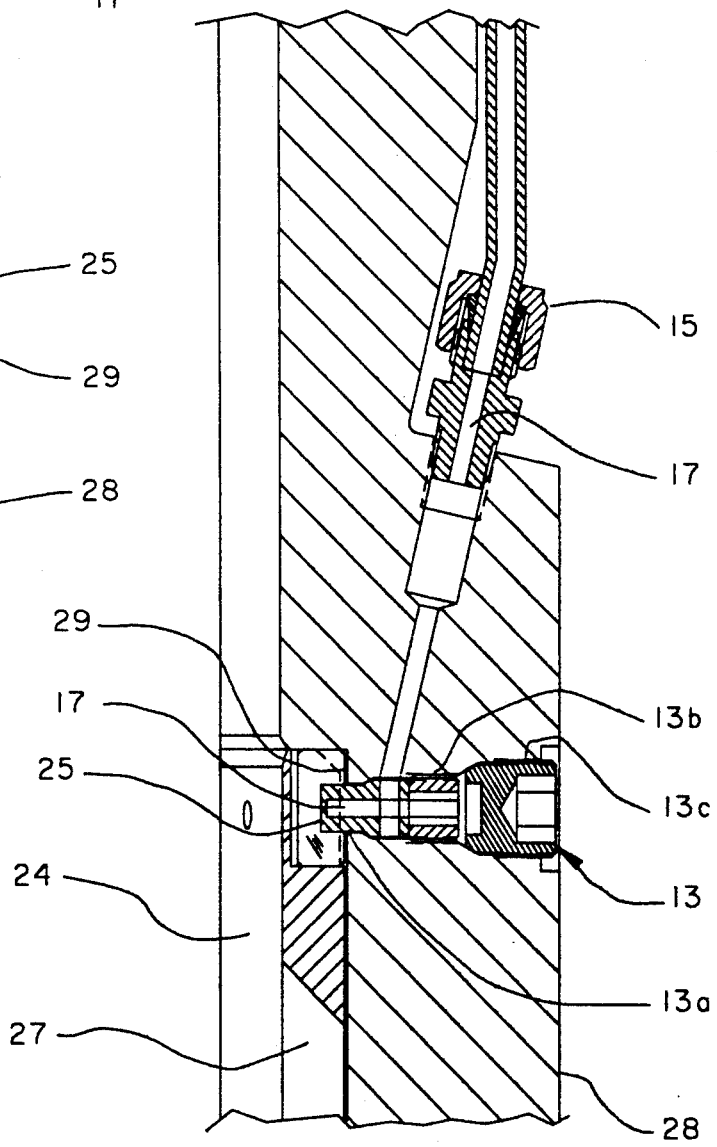

FIG. 2B shows the use of an alternative embodiment of a shearable means. Plug fitting assembly 13 is placed in the wall of nipple profile sub 28 at a 90 degree angle to sleeve 34 and has internal bore 17 which is connected to internal bore 17 of control line 12. Internal bore 17 extends far enough into cutting space 31 so that cutter 29 shears off end 25 of plug fitting 13 so as to provide communication between internal bore 17 of control line 12 and the internal bore 21 of landing nipple 10. Plug fitting assembly 13 in FIG. 2B can comprise, for example, shearable plug 13*a*, retainer 13*b* and connector 13*c*, but may be of any suitable configuration which shears to provide communication desired. At least a portion of the shearable means extends into a portion of the wall of rotary member 34.

Figure 4:
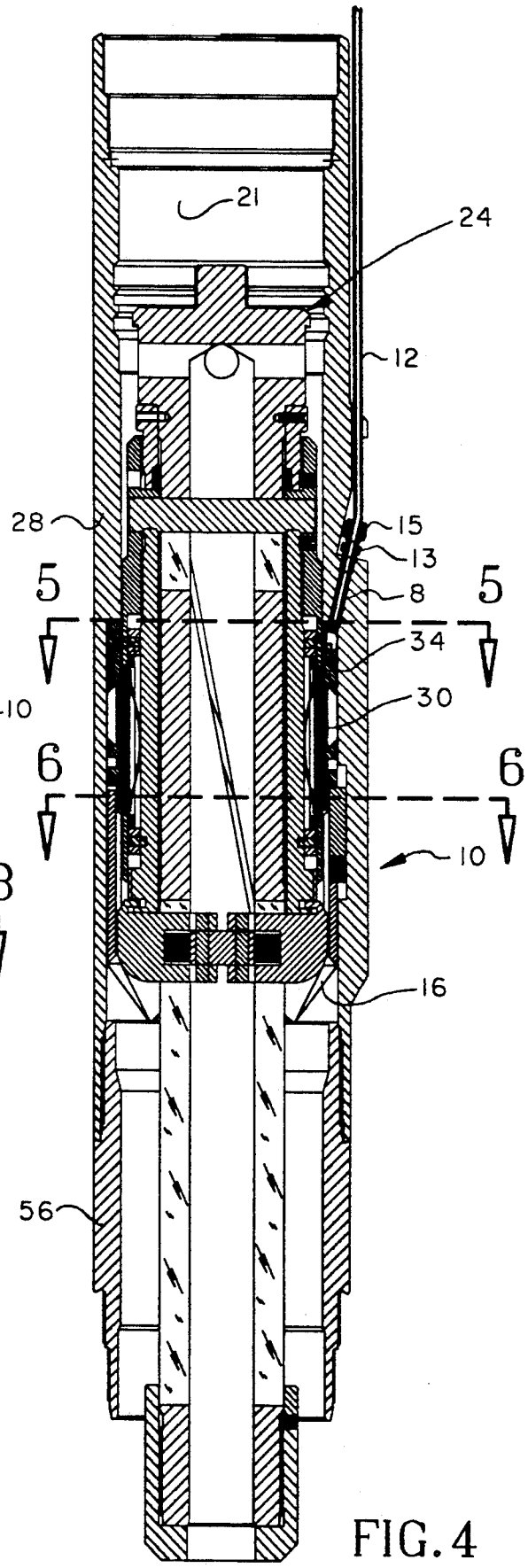
FIG. 4 is an elevational view in cross section of the landing nipple of the invention with a rotary shifter in place in its unextended position.

FIG. 4 shows landing nipple 10 with rotary shifter assembly 24 in place in the non-extended position. Rotary shifter 24 is preferably run below landing nipple 10 and then picked up or pulled up through it. The top of keys 30 are preferably pointed so that keys 30 will engage in orienting slots 22 in the lower end of guide shoe 16 and be directed into slots 26 and extended slots 27 in order to rotate sleeve 34. Because the entire shifter 24 can rotate, keys 30 and cross pin 35 are rotated into alignment with slots 26 and extended slots 27 of rotary sleeve 34. The upward facing square shoulders of keys 30 engage against the downward facing square shoulder of sleeve 34.

Figure 8:
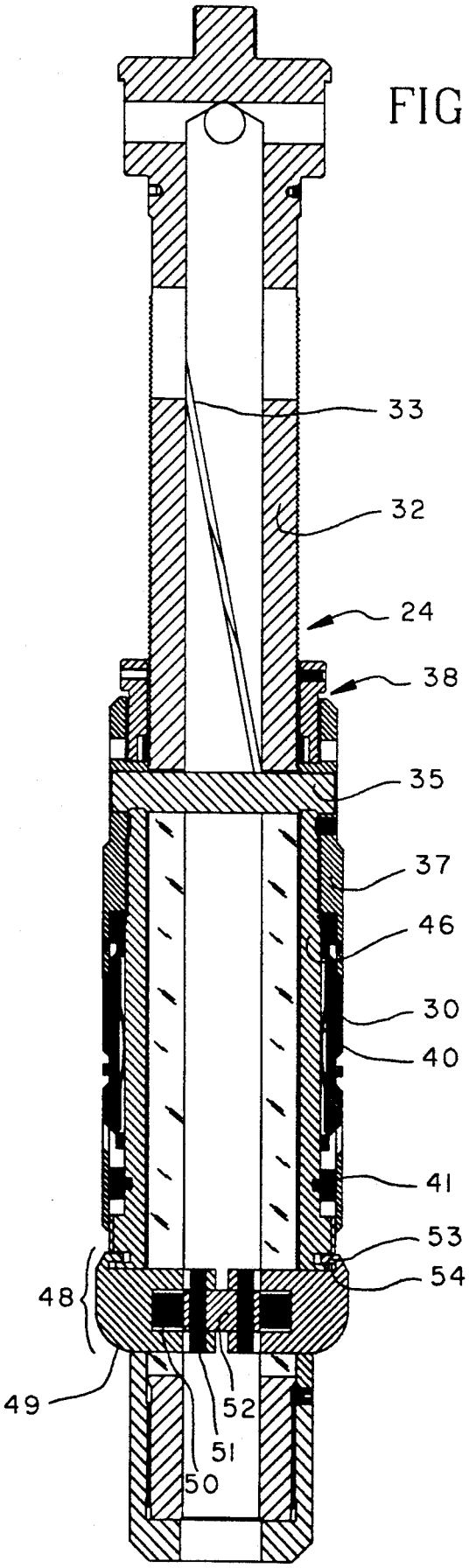
FIG. 8 is an elevational view in cross section of the rotary shifter in its fully extended position

FIG. 8 shows rotary shifter assembly 24 in its fully extended position. A travel means, preferably rotary cross pin 35, passes through inner mandrel 32. Cross pin 35 passes through the upper end of the straight portion of slots 33, and pin 35 rotates as pin 35 travels along the curved portion groove or slots 33, causing outer mandrel 38 to rotate. Key retainer housing 37 is secured to rotary cross pin 35 so that housing 37 will turn when rotary pin 35 turns. Inner mandrel 32 of rotary shifter assembly 24 and keys 30 are designed to turn when rotary pin 35 turns. Preferably, rotary sleeve 34 is rotated by applying sufficient upward force on shifter 24 to cause end 25 of plug 13 to shear although a downward force could be used instead.

Rotary shifter assembly 24 is provided with a diametrically retractable means for prevention of rotation of inner mandrel 32 through which inner mandrel 32 can slide and which allows rotation of outer mandrel 38 and cross pin 35. Preferably, this means is a lug sub assembly 48 which comprises lugs 49 retained by connector 52 and pins 51. Springs 50 allow lugs 49 to retract and compress in order to pass through honed bores and other restrictions. Lugs 49 are provided with groove 54 and ears 53 which releasably fit in a groove in shear sleeve 46 to expandably secure lug sub assembly to shear sleeve 46.

Rotatable outer mandrel means 38 for releasably engaging a desired rotatable means of a piece of equipment preferably comprises a retractable means for releasably engaging a desired rotatable means of a piece of equipment. The retractable means preferably comprises at least one key 30 and spring 40 in a key retainer housing 37 for releasably engaging a desired rotatable means of a piece of equipment. Leaf spring 40 provides an outward force on keys 30 to maintain keys 30 in the protracted position during rotation.

Rotatable outer mandrel means 38 also preferably includes shear sleeve 46 which is contiguous to inner mandrel 32 and the retractable means.

Figure 9:
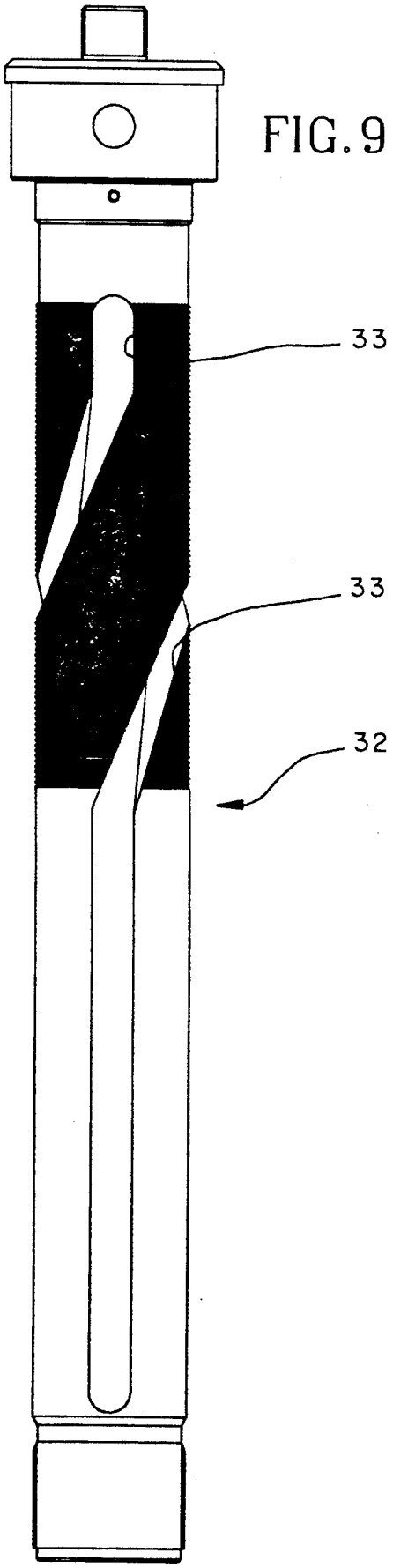
FIG. 9 is an elevational view of the inner mandrel of the rotary shifter showing the curved grooves in the inner mandrel.

Referring to FIG. 9, inner mandrel 32 is shown with two "J" mandrel slots 33 approximately 180 degrees apart, which represents the preferred configuration for the inner mandrel. Inner mandrel 32 should have at least one at least partially curved groove along the longitudinal axis of inner mandrel 32. Preferably, slots 33 form an inclined plane relative to the longitudinal axis of inner mandrel 32 and are helical.

Figure 7:
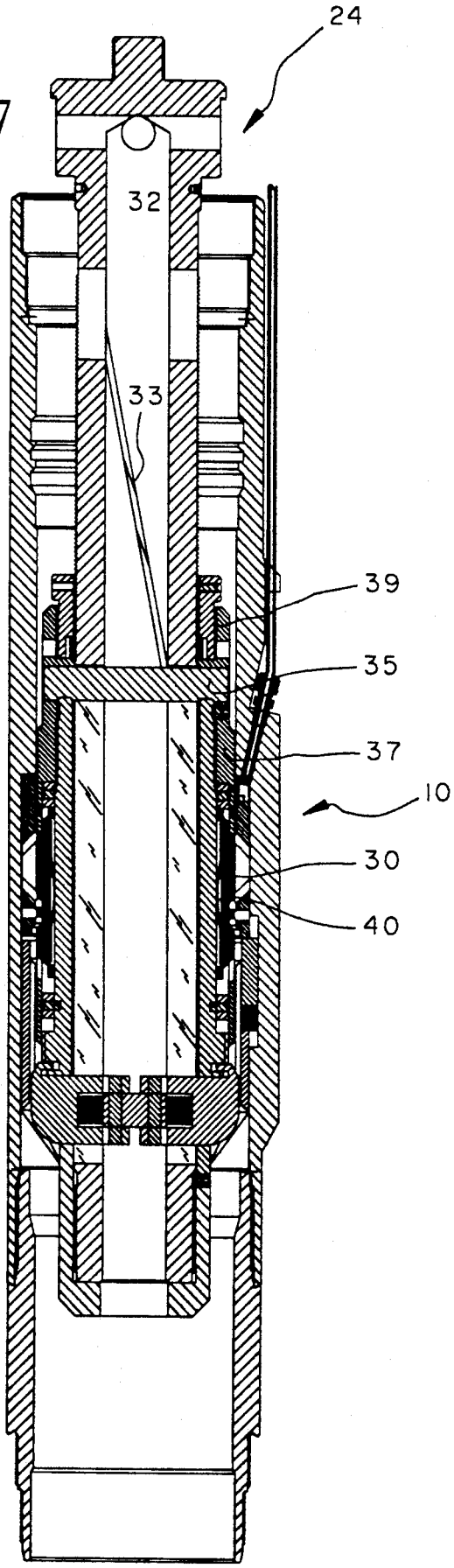
FIG. 7 is an elevational view in cross section of the landing nipple with rotary shifter in place in its fully extended position.

FIG. 7 shows landing nipple 10 and rotary shifter assembly 24 in its fully extended position.

Figure 5:
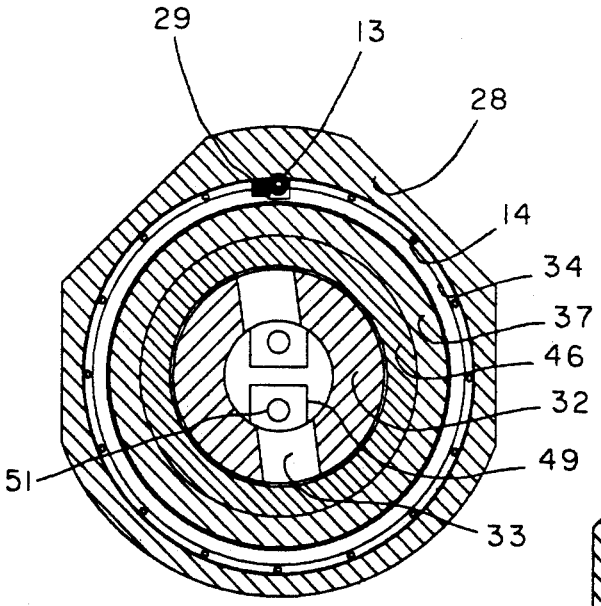
FIGS. 5 and 5A are cross sectional views of the landing nipple of the invention with rotary shifter in place taken along line 5—5 of FIG. 4.
Figure 5A:
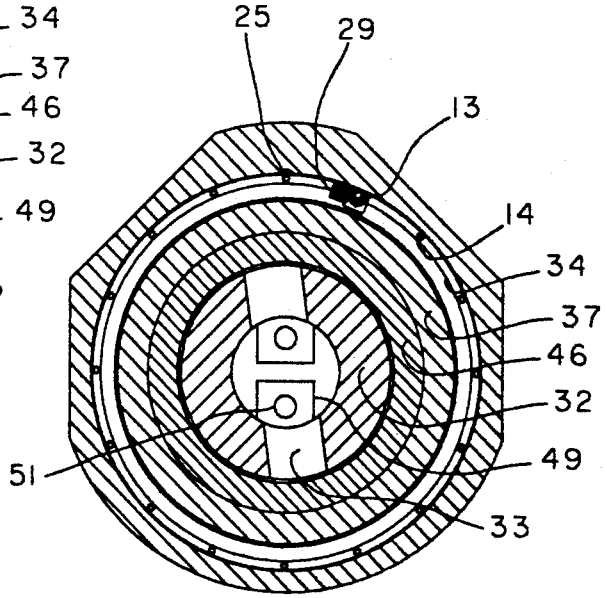

FIG. 5 and FIG. 5A show a cross-sectional view of FIG. 4, taken along line 5—5.

FIG. 5 shows nipple profile sub 28 and sleeve 34 with rotary shifter 24 in the non-extended position before any rotation of sleeve 34 has taken place. Plug fitting 13 is shown next to cutter 29. Sleeve 34 is contiguous to key retainer housing 37 and shear sleeve 46. Inner mandrel 32 is shown with slots 3 and lug 49 with pin 51.

FIG. 5A shows nipple profile sub 28 and sleeve 34 with rotary shifter 24 in a semi-extended position after rotation of sleeve 34 22.5 degrees. End 25 is shown after having been sheared.

Figure 6:
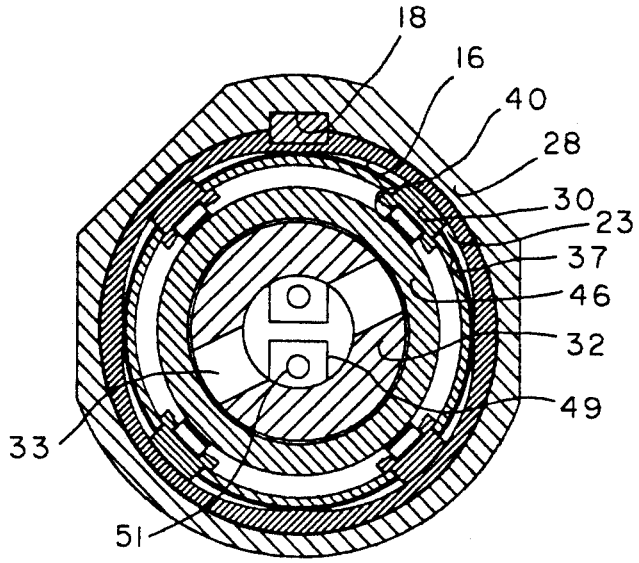
FIGS. 6, 6A and 6B are cross sectional views of the landing nipple of the invention with rotary shifter in place taken along line 6—6. of FIG. 4.
Figure 6A:
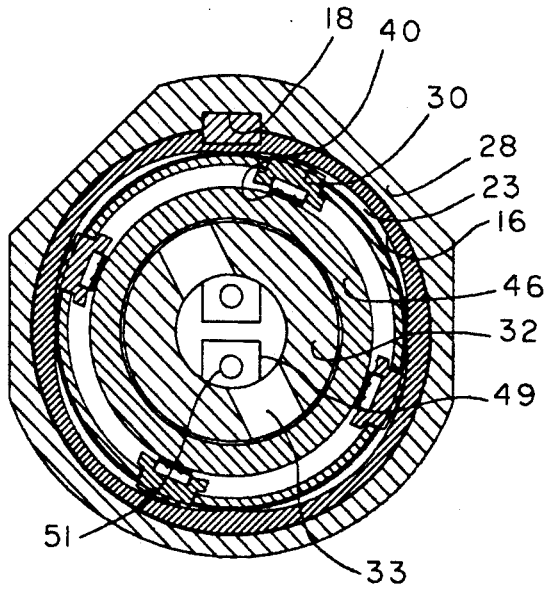
Figure 6B:
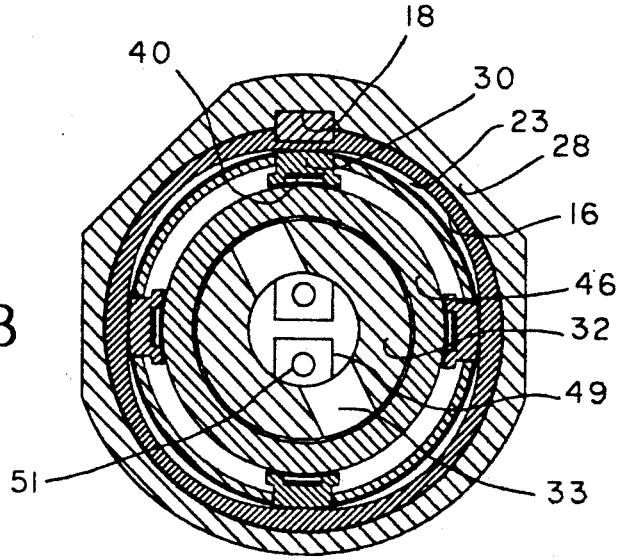

FIGS. 6, 6A and 6B show a cross-sectional view of FIG. 4, taken along line 6—6.

FIG. 6, shows nipple profile sub 28 and sleeve 34 with rotary shifter 24 in the non-extended position before any rotation of sleeve 34 has taken place. Keys 30 are shown in a fully extended position within lobes 23. Cantilever spring 40 is shown under keys 30.

FIG. 6A shows nipple profile sub 28 and sleeve 34 with rotary shifter 24 in a semi-extended position after rotation of sleeve 34 22.5 degrees. Keys 30 are moved through lobe 23 toward a retracted position.

FIG. 6B shows nipple profile sub 28 and sleeve 34 with rotary shifter 24 in a fully extended position after a 45 degree rotation of sleeve 34. Keys 30 are fully retracted in this position and are now at point 9 of lobes 23 in guide shoe 16.

After sleeve 34 rotates, and shears end 25 of plug fitting 13, continued upward jar blows cause keys 30 to rotate to the release position. Keys 30 release because of four off-center turned surfaces which are machined into the upper end of guide shoe 16. The first release position is reached after sleeve 34 has been rotated 45 degrees.

Sleeve 34 is locked from further rotational movement, thus preventing premature lockout and shifter 24 may be removed.

FIGS. 10A and 10B show landing nipple 10 with insert safety valve 45 and look mandrel 42 installed. Lock mandrel key 43 is utilized to hold lock mandrel 42 in the desired position.

This invention also comprises a method of providing communication within landing nipple 10 between surface control line 12 and the internal bore of landing nipple 10 which comprises the steps of first placing a means for rotation, preferably rotary shifter assembly 24, within a nipple profile sub and rotation means, preferably a rotary sleeve 34, and then rotating the rotary member an amount sufficient to cause at least a portion of a shearable plug assembly placed within the wall of the nipple profile sub to sever so as to provide communication between the surface control line and the internal bore of the landing nipple. The means for rotation is preferably placed through a means for guiding, preferably guide shoe 16, rotary shifter 24 into engagement with rotary sleeve 34.

Other alternatives will be obvious to one of ordinary skill in the art.

I claim:

1. A safety valve landing nipple comprising:

a nipple profile sub, a landing nipple housing connected to said nipple profile sub, a rotary member positioned inside said landing nipple housing, wherein said rotary member contains a means for engagement by a means for rotating said rotary member, a bore in the wall of said nipple profile sub to which is connected a surface control line; and a means for selectively providing communication between said surface control line and the internal bore of said landing nipple.

2. The safety valve landing nipple of claim 1, wherein said rotary member is a rotary sleeve.

3. The safety valve landing nipple of claim 1, wherein said means for engagement in said rotary member is at least one slot or protrusion in said rotary member for engagement by said means for rotating said rotary member.

4. The safety valve landing nipple of claim 1, wherein said means for rotating said rotary member is a rotary shifter with one or more keys for engagement in said means for engagement of said rotary member.

5. The safety valve landing nipple of claim 1, wherein said rotary member is a rotary sleeve which contains a plurality of slots therein.

6. The safety valve landing nipple of claim which further comprises a means for guiding said means for rotating said rotary member to engagement with said rotary member.

7. The safety valve landing nipple of claim 1, which further comprises a guide shoe positioned within said nipple profile sub and contiguous to said rotary member for guiding said means for rotating into engagement with said rotary member.

8. The safety valve landing nipple of claim 1, wherein said means for selectively providing communication between said surface control line and said internal bore of said landing nipple comprises a shearable plug assembly placed within the wall of said nipple profile sub so that an internal bore of said plug assembly is in communication with said bore in the wall of said nipple profile sub, and at least a portion of said plug extends into a portion of the wall of said rotary member, wherein said internal bore extends within said plug at least as far as the outside diameter of said rotary member, and wherein said rotary member has a cutting means for shearing the end of said plug to provide communication between the internal diameter of said rotary member and the internal bore of said plug assembly.

9. The safety valve landing nipple of claim 8, wherein said internal bore of said shearable plug assembly is positioned at an angle less than 45 degrees to the centerline of said landing nipple.

10. The safety valve landing nipple of claim 8, wherein said internal bore of said shearable plug assembly is positioned substantially perpendicular to the centerline of said landing nipple.

11. The safety valve landing nipple of claim 1, wherein said rotary member has at least one aperture placed therein to facilitate communication between the internal diameter of said rotary member and the internal bore of said plug assembly.

12. The safety valve landing nipple of claim 8, wherein said shearable plug assembly comprises a shearable plug with an internal bore where at least a portion of said internal bore of said shearable plug extends into a portion of the wall of said rotary member so as to be substantially perpendicular to the centerline of said landing nipple, a retainer connected to said shearable plug and a connector connected to said retainer, wherein said connector inhibits communication between said retainer and the outside diameter of said nipple profile sub.

13. A safety valve landing nipple comprising:

a nipple profile sub, a landing nipple housing connected to said nipple profile sub, a rotary sleeve positioned inside said nipple profile sub, wherein said rotary sleeve contains at least one slot or protrusion therein for engagement by one or more keys of a rotary shifter, a bore in the wall of said nipple profile sub, to which is connected a surface control line; and a means for selectively providing communication between said surface control line and the internal bore of said landing nipple.

14. The safety valve landing nipple of claim 13, which further comprises a means for guiding said rotary shifter into engagement with said rotary sleeve.

15. The safety valve landing nipple of claim 13, wherein said means for selectively providing communication between said surface control line and said internal bore of said landing nipple comprises a shearable plug assembly placed within the wall of said nipple profile sub so that an internal bore of said plug assembly is in communication with said bore in the wall of said nipple profile sub, and at least a portion of said plug extends into a portion of the wall of said rotary sleeve, wherein said internal bore extends within said plug at least as far as the outside diameter of said rotary sleeve, and wherein said rotary sleeve has a cutting means for shearing the end of said plug to provide communication between the internal diameter of said rotary sleeve and the said internal bore of said plug assembly.

16. The safety valve landing nipple of claim 15, wherein said internal bore of said shearable plug assembly is positioned at an angle less than 45 degrees to the centerline of said landing nipple.

17. The safety valve landing nipple of claim 15, wherein said internal bore of said shearable plug assembly is positioned substantially perpendicular to the centerline of said landing nipple.

18. The safety valve landing nipple of claim 13, wherein said rotary sleeve has at least one aperture placed therein to facilitate communication between the internal diameter of said rotary sleeve and the internal bore of said plug assembly.

19. The safety valve landing nipple of claim 15, wherein said shearable plug assembly comprises a shearable plug with an internal bore where at least a portion of said internal bore of said shearable plug extends into a portion of the wall of said rotary sleeve so as to be substantially perpendicular to the centerline of said landing nipple, a retainer connected to said shearable plug and a connector connected to said retainer, wherein said connector inhibits communication between said retainer and the outside diameter of said nipple profile sub.

20. A safety valve landing nipple comprising:

a nipple profile sub, a landing nipple housing connected to said nipple profile sub, a rotary sleeve positioned inside said nipple profile sub, wherein said rotary sleeve contains at least one slot therein for engagement by one or more keys of a rotary shifter, a means for guiding said rotary shifter into engagement with rotary sleeve, said means positioned within nipple profile sub and contiguous to rotary sleeve, a bore in the wall of said nipple profile sub, to which is connected a surface control line; and a shearable plug assembly placed within the wall of said nipple profile sub so that an internal bore of said plug assembly is in communication with said bore in the wall of said nipple profile sub and at least a portion of said plug extends into a portion of the wall of said rotary sleeve, wherein said internal bore extends within said plug at least as far as the outside diameter of said rotary sleeve, and wherein said rotary sleeve has a cutting means for shearing the end of said plug to provide communication between the internal diameter of said rotary sleeve and the internal bore of said plug assembly.

21. The safety valve landing nipple of claim 20, wherein said means for guiding said rotary shifter is a guide shoe.

22. The safety valve landing nipple of claim 20, wherein said internal bore of said shearable plug assembly is positioned at an angle less than 45 degrees to the centerline of said landing nipple.

23. The safety valve landing nipple of claim 20, wherein said internal bore of said shearable plug assembly is positioned substantially perpendicular to the centerline of said landing nipple.

24. The safety valve landing nipple of claim 20, wherein said rotary sleeve has at least one aperture placed therein to facilitate communication between the internal diameter of said rotary sleeve and the internal bore of said plug assembly.

25. The safety valve landing nipple of claim 20, wherein said shearable plug assembly comprises a shearable plug with an internal bore, where at least a portion of said internal bore of said shearable plug extends into a portion of the wall of said rotary sleeve so as to be substantially perpendicular to the centerline of said landing nipple, a retainer connected to said shearable plug and a connector connected to said retainer, wherein said connector inhibits communication between said retainer and the outside diameter of said nipple profile sub.

26. A safety valve landing nipple comprising:

a nipple profile sub, a landing nipple housing connected to said nipple profile sub, a rotary sleeve positioned inside said nipple profile sub, wherein said rotary sleeve contains at least one slot therein for engagement by one or more keys of a rotary shifter, a means for guiding said rotary shifter into engagement with said rotary sleeve, said means positioned within said nipple profile sub and contiguous to said rotary sleeve, a bore in the wall of said nipple profile sub, to which is connected a surface control line; and a shearable plug assembly placed within the wall of said nipple profile sub so that an internal bore of said plug assembly is positioned vertically within said plug, said internal bore in communication with said bore in the wall of said nipple profile sub and at least a portion of said plug assembly extends into a portion of the wall of said rotary sleeve, wherein said internal bore extends within said plug at least as far as the outside diameter of said rotary sleeve, and wherein said rotary sleeve has a cutting means for shearing the end of said plug to provide communication between said internal diameter of said rotary sleeve and the internal bore of said shearable plug assembly when said rotary sleeve is rotated as desired.

27. The safety valve landing nipple of claim 26, wherein said means for guiding said rotary shifter is a guide shoe.

28. The safety valve landing nipple of claim 26, wherein said rotary sleeve has at least one aperture placed therein to facilitate communication between the internal diameter of said rotary sleeve and the internal bore of said plug assembly.

29. The safety valve landing nipple of claim 26, wherein said shearable plug assembly comprises a shearable plug with an internal bore, where at least a portion of said internal bore of said shearable plug extends into a portion of the wall of said rotary sleeve so as to be substantially perpendicular to the centerline of said landing nipple, a retainer connected to said shearable plug, and a connector connected to said retainer, wherein said connector inhibits communication between said retainer and the outside diameter of said nipple profile sub.

30. A safety valve landing nipple comprising:

a nipple profile sub, a landing nipple housing connected to said nipple profile sub, a rotary sleeve positioned inside said nipple profile sub, wherein said rotary sleeve contains at least one slot therein for engagement by one or more keys of a rotary shifter and said rotary sleeve has at least one aperture placed therein to facilitate communication between the internal diameter of said rotary sleeve and the internal bore of a shearable plug assembly, a guide shoe positioned within said nipple profile sub and contiguous to said rotary sleeve for guiding said rotary shifter into engagement with said rotary sleeve, a bore in the wall of said nipple profile sub, to which is connected a surface control line; and a shearable plug assembly placed within the wall of said nipple profile sub so that an internal bore of said plug assembly is substantially parallel to the centerline of said landing nipple and said internal bore is in communication with said bore in the wall of said nipple profile sub and where said shearable plug assembly comprises a shearable plug with an internal bore, where at least a portion of said internal bore of said shearable plug extends into a portion of the wall of said rotary sleeve so as to be substantially parallel to the centerline of said landing nipple.

31. A method of providing communication within a landing nipple between a surface control line and the internal bore of said landing nipple, which comprises the steps of:

placing a means for rotation within a nipple profile sub and rotary member, rotating said rotary member an amount sufficient to cause at least a portion of a shearable plug assembly placed within the wall of said nipple profile sub to sever so as to provide communication between said surface control line and said internal bore of said landing nipple.

32. The method of claim 31, wherein said rotary member is a rotary sleeve.

33. The method of claim 31, wherein said means for rotation is a rotary shifting tool, wherein said rotary shifting tool contains at least one key and wherein each of said keys fits into an aperture in said rotary member and remains in an expanded position in said aperture until sufficient rotation is achieved.

34. The method of claim 31, wherein said rotary member is rotated by applying sufficient force on said means for rotation so as to rotate said rotary member an amount sufficient to cause the end of said shearable plug assembly to sever and an internal bore of said plug assembly to communicate with an aperture in said rotary member and thus provide communication between said surface control line and said internal bore of said landing nipple.

35. The method of claim 31, wherein said means for rotation within said nipple profile sub is placed through a means for guiding said rotary shifter into engagement with said rotary member.

36. The method of claim 31, wherein said shearable plug assembly comprises a shearable plug where at least a portion of said shearable plug extends into a portion of the wall of said rotary member, a retainer connected to said shearable plug and a connector connected to said retainer, and wherein said rotary member is rotated an amount sufficient to cause at least a portion of said shearable plug to sever so as to provide communication between said surface control line and said internal bore of said landing nipple.

37. A method of providing communication within a landing nipple between a surface control line and the internal bore of said landing nipple, which comprises the steps of:

placing a means for rotation within a nipple profile sub and rotary sleeve, rotating said sleeve an amount sufficient to cause at least a portion of a shearable plug assembly placed within the wall of said nipple profile sub to sever so as to provide communication between said surface control line and said internal bore of said landing nipple.

38. The method of claim 37, wherein said means for rotation is a rotary shifting tool, wherein said rotary shifting tool contains at least one key and wherein each of said keys fits into an aperture in said sleeve and remains in an expanded position in said aperture until sufficient rotation is achieved.

39. The method of claim 37, wherein said sleeve is rotated by applying sufficient force on said means for rotation so as to rotate said sleeve an amount sufficient to cause the end of said shearable plug assembly to sever and an internal bore of said plug assembly to communicate with an aperture in said sleeve and thus provide communication between said surface control line and said internal bore of said landing nipple.

40. The method of claim 37, wherein said means for rotation within said nipple profile sub is placed through a means for guiding said rotary shifter into engagement with said rotary sleeve.

41. The method of claim 37, wherein said shearable plug assembly comprises a shearable plug where at least a portion of said shearable plug extends into a portion of the wall of said rotary sleeve, a retainer connected to said shearable plug and a connector connected to said retainer, and wherein said sleeve is rotated an amount sufficient to cause at least a portion of said shearable plug to sever so as to provide communication between said surface control line and said internal bore of said landing nipple.

42. A method of providing communication within a landing nipple between a surface control line and the internal bore of said landing nipple, which comprises the steps of:

placing a rotary shifting tool within a nipple profile sub, through a means for guiding said rotary shifting tool into engagement with said rotary sleeve so that at least one key of said rotary shifter assembly fits into a slot in said sleeve and remains in an expanded position in said slot until sufficient rotation is achieved;

rotating said sleeve an amount sufficient to cause the end of said shearable plug assembly to sever and an internal bore of said plug assembly to communicate with an aperture in said sleeve and thus provide communication between said surface control line and said internal bore of said landing nipple.

43. A method of providing communication within a landing nipple between a surface control line and the internal bore of said landing nipple, which comprises the steps of:

placing a rotary shifting tool within a nipple profile sub, through a guide shoe, into engagement with said rotary sleeve, so that at least one key of said rotary shifting tool fits into at least one slot in said rotary sleeve and remains in an expanded position in said slot until sufficient rotation is achieved;

rotating said sleeve an amount sufficient so as to cause the end of said shearable plug assembly to sever and an internal bore of said plug assembly to communicate with an aperture in said rotary sleeve and thus provide communication between said surface control line and said internal bore of said landing nipple.

44. A rotary shifting tool comprising:

a rotatable outer mandrel means for releasably engaging a desired rotatable means of a piece of equipment, an inner mandrel means slidable in a longitudinal direction within said rotatable outer mandrel means, wherein said inner mandrel contains at least one at least partially curved groove along the longitudinal axis of said inner mandrel means, a travel means for traveling within said groove of said inner mandrel means, said travel means connected to said rotatable outer mandrel means, wherein said travel means rotates as said travel means travels along the curved portion of said groove, thereby causing said outer mandrel means to rotate; and a diametrically retractable means for prevention of rotation of said inner mandrel means through which said inner mandrel means can slide and which allows rotation of said outer mandrel means and said travel means.

45. The rotary shifting tool of claim 44, wherein said rotatable outer mandrel means for releasably engaging a desired rotatable means of a piece of equipment includes a retractable means for releasably engaging a desired rotatable means of a piece of equipment.

46. The rotary shifting tool of claim 44, wherein said rotatable outer mandrel means comprises a shear sleeve contiguous to said inner mandrel means and said retractable means.

47. The rotary shifting tool of claim 44, wherein said retractable means comprises at least one key and spring in a key retainer housing for releasably engaging a desired rotatable means of a piece of equipment.

48. The rotary shifting tool of claim 44, wherein said curved groove forms an inclined plane relative to said longitudinal axis of said inner mandrel means.

49. The rotary shifting tool of claim 44, wherein said curved groove is helical.

50. The rotary shifting tool of claim 44, wherein said travel means is a rotary cross pin.

51. The rotary shifting tool of claim 44, wherein said diametrically retractable means is a lug sub assembly.

52. The rotary shifting tool of claim 44, wherein said diametrically retractable means comprises a lug sub assembly comprising a lug, two pins, two springs and a connector and wherein said lug has an ear which is releasably secured in a groove in said inner mandrel.

53. A rotary shifting tool comprising:

a rotatable outer mandrel for releasably engaging a desired rotatable means of a piece of equipment, said outer mandrel comprising a retractable means for releasably engaging a desired rotatable means of a piece of equipment, and a shear sleeve contiguous to said retractable means, an inner mandrel slidable in a longitudinal direction within said outer mandrel, wherein said inner mandrel contains at least one at least partially curved groove where said groove forms an inclined plane relative to the longitudinal axis of said inner mandrel, a travel means comprising a rotary cross pin for traveling within said groove of said inner mandrel, said pin connected to said outer mandrel, wherein said rotary cross pin rotates as said rotary cross pin travels along the curved portion of said groove, thereby causing said outer mandrel to rotate; and a diametrically retractable means comprising a lug sub assembly for prevention of rotation of said inner mandrel through which said inner mandrel can slide and which allows rotation of said outer mandrel and said rotary cross pin.

54. The rotary shifting tool of claim 53, wherein said retractable means comprises at least one key and spring in a key retainer housing for releasably engaging a desired rotatable means of a piece of equipment.

55. The rotary shifting tool of claim 53, wherein said curved groove is helical.

56. The rotary shifting tool of claim 53, wherein said diametrically retractable lug sub assembly comprises a lug, two pins, two springs and a connector, wherein said lug has an ear which is releasably secured in a groove in said inner mandrel.

57. A rotary shifting tool comprising:

a rotatable outer mandrel for releasably engaging a desired rotatable means of a piece of equipment, said outer mandrel comprising a retractable means for releasably engaging a desired rotatable means of a piece of equipment, said retractable means comprising at least one key and spring in a key retainer housing and a shear sleeve contiguous to said retractable means, an inner mandrel slidable in a longitudinal direction within said outer mandrel, wherein said inner mandrel contains two at least partially curved helical grooves, where said grooves form an inclined plane relative to the longitudinal axis of said inner mandrel, a travel means comprising a rotary cross pin for traveling within said groove of said inner mandrel, said pin connected to said outer mandrel, wherein said rotary cross pin rotates as said rotary cross pin travels along the curved portion of said groove, thereby causing said outer mandrel to rotate; and a diametrically retractable means comprising a lug sub assembly for prevention of rotation of said inner mandrel through which said inner mandrel can slide and which allows rotation of said outer mandrel and said rotary cross pin.

58. The rotary shifting tool of claim 57, wherein said diametrically retractable lug sub assembly comprises a lug, two pins, two springs and a connector, wherein said lug has an ear which is releasably secured in a groove in said inner mandrel.

* * * * *

UNITED STATES PATENT AND TRADEMARK OFFICE

CERTIFICATE OF CORRECTION

PATENT NO. : 5,226,483

DATED : July 13, 1993

INVENTOR(S) : Jimmie R. Williamson, Jr.

It is certified that error appears in the above-indentified patent and that said Letters Patent is hereby corrected as shown below:

Column 7:

Claim 6, line 24, following "claim," insert --1--.

Signed and Sealed this

Second Day of August, 1994

*Attest:*

Bruce Lehman

BRUCE LEHMAN

*Attesting Officer*

*Commissioner of Patents and Trademarks*